US012698067B2

(12) United States Patent
Visser

(10) Patent No.: US 12,698,067 B2
(45) Date of Patent: Aug. 4, 2026

(54) METHOD FOR RETRIEVING AN OBJECT EXPOSED TO A BODY OF WATER

(71) Applicant: HOLLAND MARINE PROJECTS B.V., Emmeloord (NL)

(72) Inventor: Ewoud Hendrik Visser, Emmeloord (NL)

(73) Assignee: HOLLAND MARINE PROJECTS B.V., Emmeloord (NL)

( * ) Notice: Subject to any disclaimer, the term of this patent is extended or adjusted under 35 U.S.C. 154(b) by 727 days.

(21) Appl. No.: 18/006,597

(22) PCT Filed: Jul. 21, 2021

(86) PCT No.: PCT/NL2021/050466
§ 371 (c)(1),
(2) Date: Jan. 24, 2023

(87) PCT Pub. No.: WO2022/019763
PCT Pub. Date: Jan. 27, 2022

(65) Prior Publication Data

US 2023/0271683 A1 Aug. 31, 2023

(30) Foreign Application Priority Data

Jul. 24, 2020 (NL) ..... 2026141

(51) Int. Cl.
*B63C 7/14* (2006.01)

(52) U.S. Cl.
CPC ..... *B63C 7/14* (2013.01)

(58) Field of Classification Search
CPC ..... B63C 7/14; B63C 7/00; B63C 2007/125
See application file for complete search history.

(56) References Cited

U.S. PATENT DOCUMENTS 1,848,581 A * 3/1932 Stein ..... B63C 7/14 114/50
3,827,383 A 8/1974 Winer et al.
4,540,370 A 9/1985 Hebert
4,690,087 A * 9/1987 Hadjis ..... B63C 7/14 114/50

(Continued)

FOREIGN PATENT DOCUMENTS

DE 214102 C 10/1909
GB 243802 A * 12/1925 ..... B63C 7/12

(Continued)

OTHER PUBLICATIONS

International Search Report mailed Jan. 27, 2022 issued in connection with International Application No. PCT/NL2021/050466 (5 pages total).

(Continued)

*Primary Examiner* — Andrew Polay
(74) *Attorney, Agent, or Firm* — Tatonetti IP

(57) ABSTRACT

A method for retrieving an object exposed to a body of water. The freezing of water is a very power- and time-consuming operation and therefore, can be quite costly. To reduce at least one of these problems, an aqueous viscous mass is provided in a zone adjacent to an outer section of an object, and then the mass is frozen to the object. In some implementations, a thermal conductivity-promoting agent, such as metal, is used, among other variations.

18 Claims, 5 Drawing Sheets

(56) References Cited

U.S. PATENT DOCUMENTS 5,667,340 A * 9/1997 Bury ..... C04B 40/0028
405/266
6,843,191 B1 * 1/2005 Makotinsky ..... B63C 7/14
114/51

FOREIGN PATENT DOCUMENTS

JP H0481386 A 3/1992
NO 20131539 A1 5/2015

OTHER PUBLICATIONS

Written Opinion of the International Searching Authority issued Jan. 27, 2022 issued in connection with International Application No. PCT/NL2021/050466 (4 pages total).

* cited by examiner

METHOD FOR RETRIEVING AN OBJECT EXPOSED TO A BODY OF WATER

CROSS-REFERENCES TO RELATED APPLICATIONS

This Non-Provisional Utility patent application claims the benefit of and priority to PCT Application Serial No. PCT/NL2021/050466, filed Jul. 21, 2021, entitled "A method for retrieving an object exposed to a body of water," which claims the benefit of and priority to The Netherlands Patent Application Serial No. NL2026141, filed Jul. 24, 2020, entitled "A method for retrieving an object exposed to a body of water," the entire contents of both applications of which are hereby incorporated herein by reference.

BACKGROUND

The present invention relates to a method for retrieving an object exposed to a body of water.

Such a method for retrieving an object is known in the art. NO20131539A1 discloses a method of freezing water at an outer surface of the object. The ice formed around the object to be retrieved improves the structural integrity and thus reduces the risk of breaking or disintegration of the object to be lifted from the bottom of the body of water.

The freezing of water is, however, a very power consuming and time consuming operation and therefore, it is very costly.

SUMMARY

It is an object of the invention to reduce at least one of the above problems.

To this end, a method according to the preamble is characterized in that prior to retrieving the object, the method comprises the steps of providing an aqueous viscous mass in a zone adjacent to an outer section of the object, and freezing said mass to the object.

The outer section comprises an inner surface and an outer surface, and said inner surface and/or said outer surface are exposed to the body of water. The outer section may for example be comprised in a hull of a ship.

The mass has a viscosity which is larger than the viscosity of the body of water the object is exposed to.

Thus, during the time the mass is cooled to freeze it, the mass is better capable of retaining its position in the zone and thermal losses are reduced. This allows the freezing process to be performed more quickly and/or with reduced energy consumption and thus saving cost.

The mass may be a gel which is supplied into the zone. In order to form the mass, a viscosity increasing agent is mixed with water. This results in the formation of the aqueous viscous mass, which is then transported to the zone. Alternatively it could be possible that the gel is formed in situ in the zone by mixing the viscosity increasing agent with the water of the body of water. The water used for forming the mass may be water of the body of water or may be supplied from an external water source, such as a fresh water source, which may provide a mass having better properties than a mass formed using sea water.

The viscosity of the mass is for example at least 50× the viscosity of the water of the body of water, more preferably at least 150×.

It is preferred that the aqueous viscous mass is a thixotropic aqueous mass, which will display an increase in viscosity after being transported to or formed in the zone. If a thixotropic mass is supplied as a pre-formed mass, a conduit used for supplying the mass may contain one or more static mixers along its length helping to keep the mass flowing well.

According to another embodiment, the step of providing the aqueous viscous mass in a zone adjacent to the outer section of the object comprises providing a thermal conductivity promoting agent.

In this way, the step of freezing the mass to the object is expedited. Alternatively, less energy is required to freeze the mass in the same amount of time as compared to freezing a corresponding mass lacking the thermal conductivity promoting agent.

The thermal conductivity promoting agent is for example graphite, silicon carbide or boron nitride (BN).

Preferably, the thermal conductivity promoting agent is provided as a powder. In this way, the agent may be distributed in the mass more homogeneously, thereby expediting freezing of the mass even further.

Preferably, a mixture of the thermal conductivity promoting agent and the viscosity increasing agent is formed in a first step, after which water is added to the mixture in a second step, resulting in an aqueous viscous mass comprising the thermal conductivity increasing agent. Prior to being added to the mixture in the second step, the water may be pre-cooled to a temperature of 0.5-10° C., preferably 1-5° C. to facilitate subsequent freezing of the mass.

According to another embodiment, the thermal conductivity promoting agent is a metal.

Due to a relatively high thermal conductivity, metals contribute to expediting the freezing of the mass.

Preferably, the metal has a thermal conductivity at 0° C. of 50-425 W/m·K, such as iron or copper.

According to another embodiment, the metal is aluminium.

Aluminium is relatively cheap and widely available.

According to another embodiment, the step of providing the aqueous viscous mass in a zone adjacent to the outer section of the object comprises providing reinforcement fibers to the aqueous viscous mass.

The fibers aid in maintaining the integrity of the frozen mass while the object is being retrieved. Especially when the object is located at a sea bottom, pressure on the object and frozen mass will reduce while the object is being retrieved from the sea bottom, resulting in the frozen mass expanding and increasing the risk of fracturing of the frozen mass due to increasing tensile forces in the frozen mass. The fibers help to resist the increasing tensile forces and reduce the risk of the frozen mass developing fractures while the object is being retrieved.

Preferably, the fibers are aluminium fibers, so the fibers can provide resistance against increasing tensile forces while the object is being retrieved, and act to promote thermal conductivity of the aqueous viscous mass to expedite freezing of the mass.

According to another embodiment, the step of providing the aqueous viscous mass comprises providing a biological viscosity increasing agent to the aqueous viscous mass.

Examples of biological viscosity increasing agents include cellulose, pectin and starch. These are non-toxic and environment friendly, and form a viscous mass when contacting water. Alginate is also a natural viscosity increasing agent, and forms a gel in the presence of Ca' ions. Therefore the formation of the viscous mass can be conveniently controlled by supplying Ca', for example using a static mixer. Thus the risk of clogging of hoses or equipment used for preparing the viscous mass is reduced.

According to another embodiment, the step of providing the aqueous viscous mass comprises providing a synthetic polymer to the aqueous viscous mass.

Examples of synthetic polymers include super absorbent polymers such as polyacrylate (e.g in the form of sodium polyacrylate), and carboxy alkyl cellulose. In some cases, super absorbent polymers can absorb even up to 1000× their own weight in liquid. Polyacrylate for example can absorb up to 400 times its own weight in water, and in sea water up to 40 times its own weight.

It is also possible to provide the increased viscosity using a mixture of one or more biological viscosity increasing agent and one or more synthetic polymers.

According to another embodiment, the mass comprises a density increasing agent to the aqueous viscous mass.

Without the density increasing compound, the density of the mass may be lower than the surrounding water giving it a tendency to rise. The density increasing compound has a density that is more than 1.05 kg/liter, and for salt water bodies more than 1.1 kg/liter. The compound is for example a clay.

According to another embodiment, when the body of water is a body of salt water, fresh water is provided to the zone simultaneously with providing the aqueous viscous mass.

Fresh water has a higher freezing point than salty water. Therefore freezing of the mass comprising fresh water will be faster and thus more cost-efficient. It may also reduce the consumption of the viscosity increasing agent, e.g. in case the agent is less capable of swelling in salt water compared to fresh water.

According to another embodiment, prior to providing an aqueous viscous mass in a zone adjacent to an outer section of the object, a compressible body is inserted into the object.

The compressible body acts to reduce the chance of rupture of the object when the viscous mass expands due to freezing.

Preferably, the compressible body is of a closed cell structure.

According to another embodiment, a delivery device is arranged for providing the mass in the zone, the delivery device having an outlet opening for the mass or an agent conducive in forming the mass;

wherein the step of providing the viscous mass comprises the steps of:

positioning the outlet opening of the delivery device into the zone at a first side of said zone;

moving the outlet opening of the delivery device along a path through the zone to a second side thereof spaced apart from the first side while providing the viscous mass.

The delivery device can for example be a lance. In this way, the viscous mass formed at the outlet opening of the delivery device fills the zone starting from the first side of the zone towards the second side. When the mass is subsequently frozen, it will form a solid clump in the zone. This can provide structural integrity to an object which would otherwise be too fragile to handle and/or provide a sturdier surface to an object which is otherwise too weak to withstand the pressure of a handling device, or to objects which could react on the direct pressure of the handling device.

According to another embodiment, a mixing device is arranged in the zone adjacent to the object, and the water in the zone is put in motion by the mixing device while providing the aqueous viscous mass.

Because of the viscosity of the mass, it may be difficult to fill a larger zone with the mass, and the mass may even obstruct the delivery device. The mixing device moves the water in the zone where the mass is provided. Therefore, the mass will fill the zone in a more uniform way and clogging of the delivery device is prevented. This contributes to a more homogeneously distributed mass, and thus to a more efficient freezing of the mass. The mixing device can for example be a stirring unit or a blowing unit blowing for example air or water into the zone. Furthermore, the mixing device can be a separate mixing device or be incorporated in for example the delivery device.

According to another embodiment, the method comprises, prior to the step of providing the mass and in no particular order, the steps of:

arranging a conduit system at least partially in the zone; and connecting the conduit system to a cooling device.

In this way, the conduit system is arranged in the zone to be cooled before the mass is frozen. When a coolant, for example liquid nitrogen, is run through the conduit system driven by the cooling device, the mass will be cooled in a more uniform manner, resulting in a faster freezing of the mass.

Preferably, conduits of the conduit system are vacuum insulated in order to reduce thermal losses while the coolant is being transported to the zone where the aqueous viscous mass to be frozen is located.

According to another embodiment, the method comprises, after the step of freezing the viscous mass, the step of:

disconnecting the conduit system from the cooling device.

In this way, the solid clump may be transported without damaging the conduit system.

According to another embodiment, the method comprises, prior to the step of providing the aqueous viscous mass, the step of:

arranging a barrier device over at least a portion of the object; and wherein the step of delivering the aqueous viscous mass comprises providing the aqueous viscous mass in a zone adjacent to the barrier device.

In this way, the mass can be directed to be provided in a more specific location (between the outer section of the object and the barrier device) and only a limited amount of mass has to be cooled.

The barrier device may be a flexible cover like a tent, or rigid in which case it may for example be a caisson; and is placed over the object.

According to another embodiment, the method comprises, prior to the step of freezing the mass, the step of:

arranging an anchor point to be affixed to the object.

By arranging the anchor point prior to freezing the mass, the anchor point will become part of the solid clump formed after freezing the mass. The anchor point can then be used to attach for example a lifting wire or chain to the object. In this way, the solid clump provides structural integrity to the object and the object can withstand forces necessary to parbuckle and/or lift the object.

In case a delivery device is employed for providing the mass in the zone, the delivery device may also serve as anchor point.

According to another embodiment, the body of water is located above a bed, and the object is an object located on the bed.

The bed may for example be a seabed of a bottom of a lake. Objects located at the bed include objects posing a risk for the environment, such as bombs that did not explode, sunken submarines and objects containing hazardous substances. Due to their dangerous nature, it is important to salvage and safely process such objects. The method provides a way of covering objects with a layer of the mass and/or to provide structural integrity by filling an interior space of an object with the mass. After freezing the mass, the object is included in an solid clump and safer handling and transporting of the object is facilitated.

According to another embodiment, the object is a wrecked ship comprising a damaged hull.

A damaged hull prevents a wrecked ship from being transported over water to a location where it can be repaired or disassembled. The damaged hull can for example contain an opening and/or cracks, which can be located above and/or under the water level. In an embodiment, a barrier device can be placed in the opening or cracks so as to plug the opening or cracks, in which the aqueous mass is provided and frozen. As a result, a patch is formed over the opening and/or cracks and the seaworthiness of the ship is at least temporary recovered and the ship may be transported over water to a location to be definitively repaired or dismantled without the need of demolishing the ship at the site of the wreck.

BRIEF DESCRIPTION OF THE DRAWINGS

The present invention will now be illustrated with reference to the drawing where.

DETAILED DESCRIPTION

Figure 1:
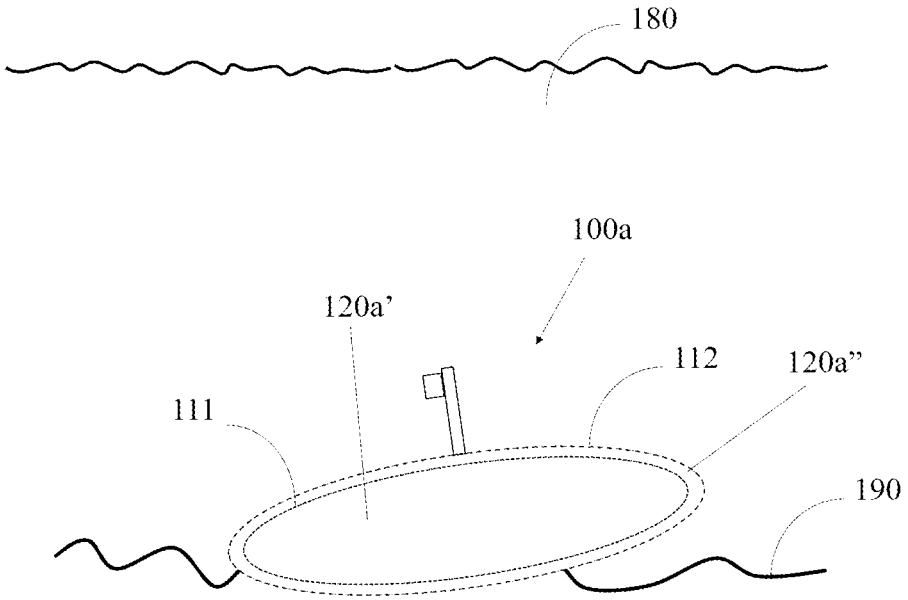
FIG. 1 shows a method of conditioning an object on the seabed.

FIG. 1 shows a schematic view of an object 100, here a sunken submarine 100*a*, which is located in a body of water 180 on a bed 190. The submarine 100*a* comprises an inner hull 111 and an outer hull 112. In this example, the inner hull 111 and the outer hull 112 are partly disintegrated and too fragile to be handled by a transport device (not shown). Therefore, an aqueous viscous mass is provided in an space 120*a*' and/or in a space 120*a*" between the inner hull 111 and the outer hull 112 of the submarine 100*a*. According to the invention, said mass is subsequently frozen by means of a cooling device (not shown). The mass is frozen more efficiently compared to water, because the flow of water in the zone is reduced due to the viscosity of the mass. Therefore the flow of already cooled mass leaving the zone is reduced, and also heat exchange between cooled mass and adjacent relatively warm water of mass due to a flow of water is reduced. The result is the formation of a solid clump in the space 120*a*' and/or in a space 120*a*" between the inner hull 111 and the outer hull 112 of the submarine 100*a*. This solid clump provides structural integrity to the submarine 100*a* and closes off holes in the inner hull 111, which allows for a transport device (not shown) to transport the submarine 100*a* to a location where it can be dismantled. Optionally, relatively large holes in the outer hull 112 can be covered with a patch, such as a blanket, prior to providing the mass in order to provide a more defined space where the mass can be provided.

Figure 2:
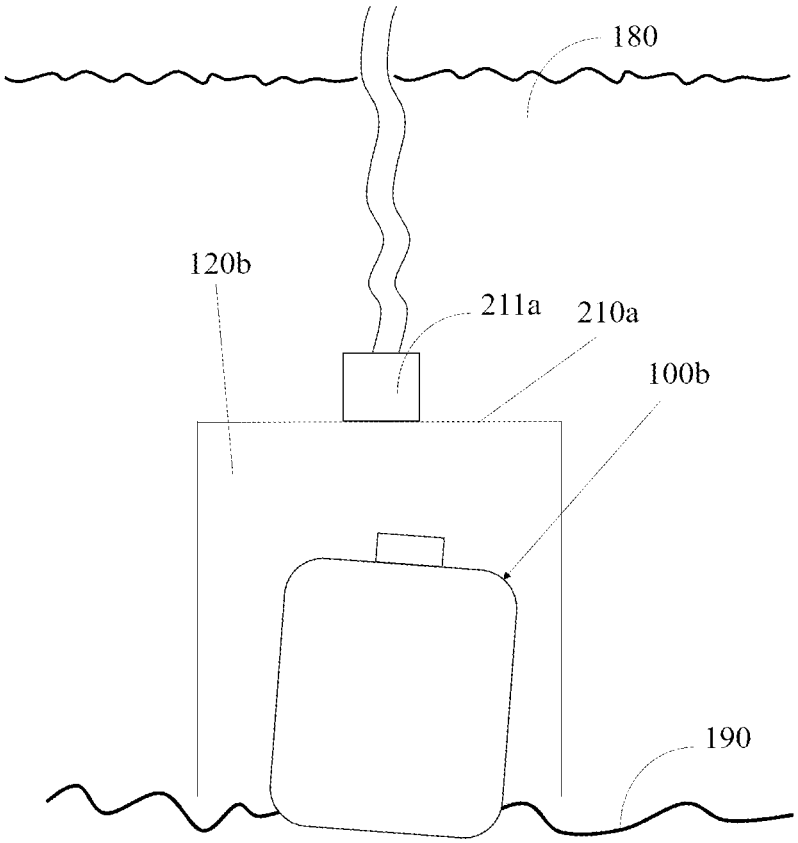
FIG. 2 shows a method of conditioning an object which poses a risk for the environment.

FIG. 2 shows another embodiment of the invention in a schematic view of an object 100, here a bomb 100*b*, which is located in a body of water 180 on a bed 190. Direct handling of the bomb 100*b* may trigger an activation mechanism and cause an explosion. Therefore, a barrier device 210, here a barrier device 210*a* comprising an inlet 211*a*, is placed over the bomb 100*b* and a portion of the body of water 180, defining a space 120*b*. Subsequently, an aqueous viscous mass is provided in the space 120*b* via the inlet 211*a*. Freezing the mass by means of a cooling device (not shown) results in the formation of a solid clump in which the bomb 100*b* is contained. As a result, the solid clump containing the bomb 100*b* can now be transported by a transport device (not shown) in a safer way to a location where the bomb 100*b* can be dismantled.

Figure 3:
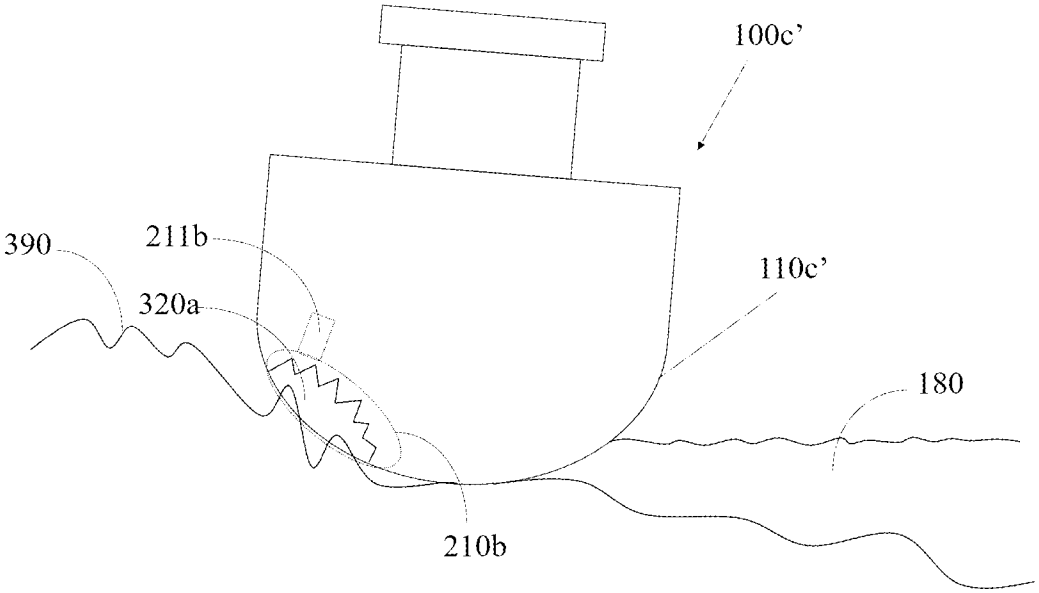
FIG. 3 shows a method for conditioning a wrecked ship on a coast with damage above the water surface.

FIG. 3 shows a schematic cross section of an object 100, here a wrecked ship 100*c*', on a coast 390. The ship 100*c*' comprises a hull 110*c*' with an opening 320*a* which is partly exposed to a body of water 180. In order to be able to transport the ship 100*c*' over water to a location where it can be dismantled or repaired, a barrier device 210, here barrier device 210*b* comprising an inlet 211*b*, is placed in the opening 320*a*. An aqueous viscous mass is provided in the barrier device 210*b* via the inlet 211*b*. When the mass is frozen by a cooling device (not shown), the mass forms together with the barrier device 210*b* a patch over the opening 320*a* and the ship 100*c*' is at least temporarily seaworthy. The ship 100*c*' can now be dragged by a transportation device (not shown) to the location where it can be dismantled or repaired without having to be demolished at the location where the ship 100*c*' stranded on the coast 390.

Figure 4:
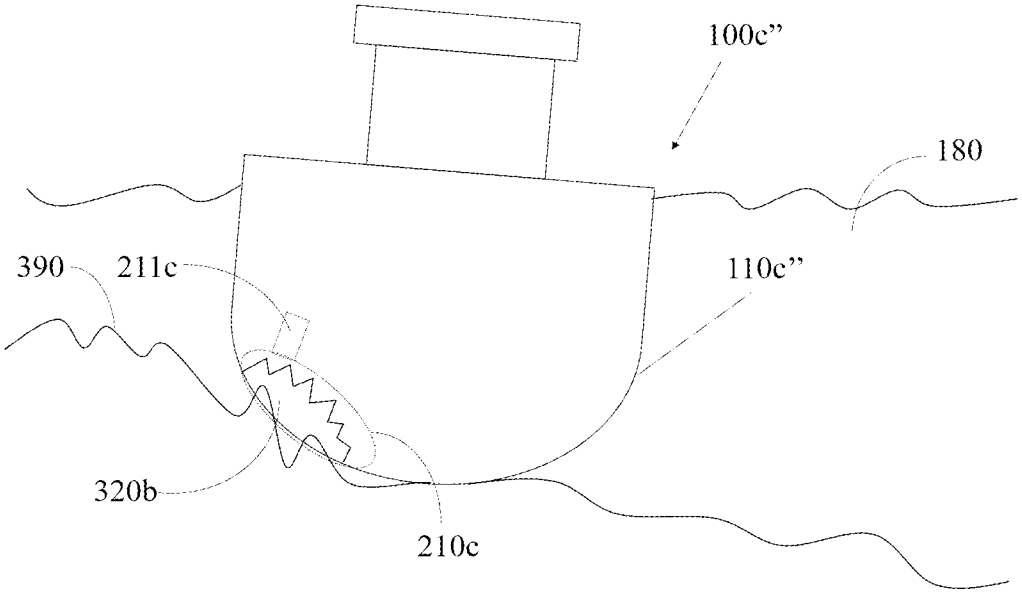
FIG. 4 shows a method for conditioning a wrecked ship on a coast with damage below the water surface.

FIG. 4 shows a schematic cross section of a object 100, here an other wrecked ship 100*c*", on a coast 390. The ship 100*c*" comprises a damaged hull 110*c*" with an opening 320*b* which is exposed to a body of water 180. In order to be able to transport the ship 100*c*" over water to a location where it can be dismantled or repaired, a barrier device 210, here barrier device 210*c* comprising an inlet 211*c*, which barrier device 210*c* is, according to the invention, placed in the opening 320*b*. According to the invention, an aqueous viscous mass is provided in the barrier device 210*c*. When said mass is frozen by a cooling device (not shown), the opening 320*b* is sealed and the ship 100*c*" is at least temporarily seaworthy. The ship 100*c*" can now be dragged by a transportation device (not shown) to the location where it can be dismantled or repaired without having to be demolished at the location where the ship 100*c*" stranded on the coast 390.

In case a rather large portion of the hull 110*c*" of the ship 100*c*" is having an opening due to damage, the barrier device 210*c* may consist of a cover plate of similar dimensions as the opening 320*b* which may be arranged at the inner side of the hull 110*c*" to provisionally cover the opening 320*b*. According to the invention, a conduit system may be arranged in a space extending between the inner side of the hull 110*c*" and the cover plate, followed by providing the mass in the space. Subsequently, the mass is frozen by means of a cooling device arranged near the object.

Figure 5:
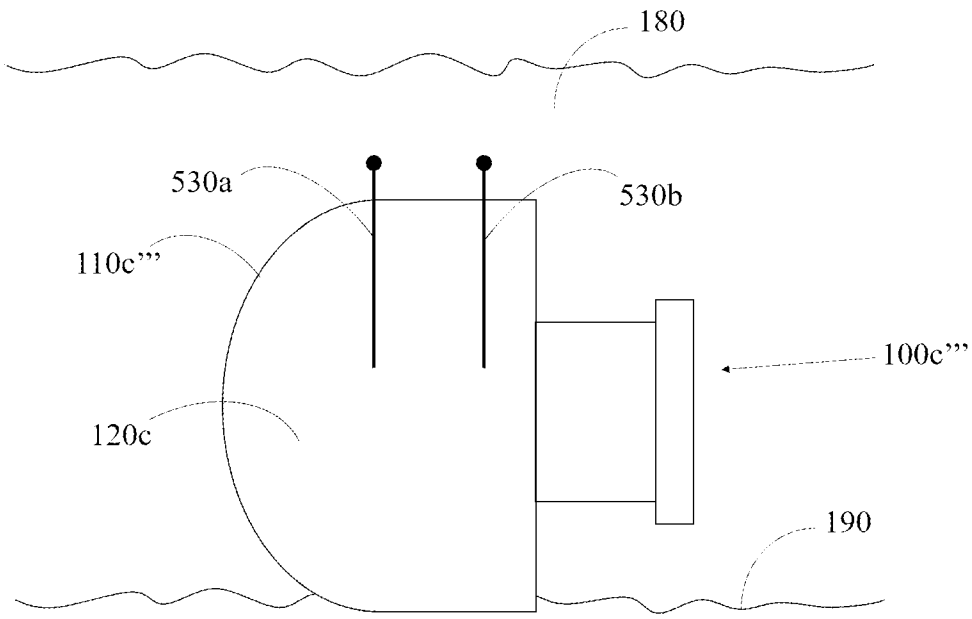
FIG. 5 shows a method for conditioning a sunken and toppled ship for parbuckling.

FIG. 5 shows a schematic cross section of an object 100, here a sunken and toppled ship 100*c*'", on a bed 190 in a body of water 180. In order to parbuckle the ship 100*c*'", an anchor point 530, here anchor points 530*a* and 530*b*, are inserted in a space 120*c* through the hull 110*c*'" prior to freezing the aqueous viscous mass provided in the space

120*c*. In this way, the anchor points 530*a* and 530*b* are taken up in the solid clump formed after freezing the mass in the space 120*c*. The anchor points 530*a* and 530*b* can now be used to attach for example a lifting wire or chain, enabling a lifting device (not shown) to parbuckle and/or lift the ship 100*c*'", because the frozen mass will provide the ship 100*c*'" the necessary integrity to withstand the exerted forces during parbuckling and/or lifting and prevent rupture of the hull 110*c*'". The use of anchor points is not limited to this example, but could also be used to retrieve other objects such as a sunken submarine as shown in FIG. 1.

The invention claimed is:

1. A method for retrieving an object exposed to a body of water, wherein prior to retrieving the object, the method comprises the steps of:

forming an aqueous viscous mass by mixing a viscosity increasing agent with water, providing the aqueous viscous mass in a zone adjacent to an outer section of the object; and subsequently freezing said mass to the object, such that the mass forms a solid clump in the zone which provides structural integrity to the object.

2. The method of claim 1, wherein the step of providing the aqueous viscous mass in a zone adjacent to the outer section of the object comprises providing a thermal conductivity promoting agent.

3. The method of claim 2, wherein the thermal conductivity promoting agent is a metal.

4. The method of claim 3, wherein the metal is aluminium.

5. The method of claim 1, wherein the step of providing the aqueous viscous mass in a zone adjacent to the outer section of the object comprises providing reinforcement fibers to the aqueous viscous mass.

6. The method of claim 1, wherein the step of providing the aqueous viscous mass comprises providing a biological viscosity increasing agent to the aqueous viscous mass.

7. The method of claim 1, wherein the step of providing the aqueous viscous mass comprises providing a synthetic polymer to the aqueous viscous mass.

8. The method of claim 1, wherein the mass comprises a density increasing agent to the aqueous viscous mass.

9. The method of claim 1, wherein when the body of water is a body of salt water, fresh water is provided to the zone simultaneously with providing the aqueous viscous mass.

10. The method of claim 1, wherein prior to providing an aqueous viscous mass in a zone adjacent to an outer section of the object, a compressible body is inserted into the object.

11. The method of claim 1, wherein a delivery device is arranged for providing the mass in the zone, the delivery device having an outlet opening for the mass or an agent conducive in forming the mass;

wherein the step of providing the viscous mass comprises the steps of:

positioning the outlet opening of the delivery device into the zone at a first side of said zone;

moving the outlet opening of the delivery device along a path through the zone to a second side thereof spaced apart from the first side while providing the viscous mass.

12. The method of claim 1, wherein a mixing device is arranged in the zone adjacent to the object, and the water in the zone is put in motion by the mixing device while providing the aqueous viscous mass.

13. The method of claim 1, wherein the method comprises, prior to the step of providing the mass and in no particular order, the steps of:

arranging a conduit system at least partially in the zone; and connecting the conduit system to a cooling device.

14. The method of claim 13, wherein the method comprises, after the step of freezing the viscous mass, the step of:

disconnecting the conduit system from the cooling device.

15. The method of claim 1, wherein the method comprises, prior to the step of providing the aqueous viscous mass, the step of:

arranging a barrier device over at least a portion of the object; and wherein the step of delivering the aqueous viscous mass comprises providing the aqueous viscous mass in a zone adjacent to the barrier device.

16. The method of claim 1, wherein the method comprises, prior to the step of freezing the mass, the step of:

arranging an anchor point to be affixed to the object.

17. The method of claim 1, wherein the body of water is located above a bed, and the object is an object located on the bed.

18. The method of claim 1, wherein the object is a wrecked ship comprising a damaged hull.

* * * * *